US011557830B2

(12) United States Patent
Kim et al.

(10) Patent No.: US 11,557,830 B2
(45) Date of Patent: Jan. 17, 2023

(54) FILM ANTENNA-CIRCUIT CONNECTION STRUCTURE AND DISPLAY DEVICE INCLUDING THE SAME

(71) Applicants: DONGWOO FINE-CHEM CO., LTD., Jeollabuk-do (KR); POSTECH RESEARCH AND BUSINESS DEVELOPMENT FOUNDATION, Gyeongsangbuk-do (KR)

(72) Inventors: Jong Min Kim, Gyeonggi-do (KR); Chan Hee Lee, Gyeonggi-do (KR); Yun Seok Oh, Gyeonggi-do (KR); Won Bin Hong, Seoul (KR)

(73) Assignees: DONGWOO FINE-CHEM CO., LTD., Jeollabuk-Do (KR); POSTECH RESEARCH AND BUSINESS DEVELOPMENT FOUNDATION, Gyeongsangbuk-Do (KR)

( * ) Notice: Subject to any disclaimer, the term of this patent is extended or adjusted under 35 U.S.C. 154(b) by 0 days.

(21) Appl. No.: 16/935,736

(22) Filed: Jul. 22, 2020

(65) Prior Publication Data

US 2020/0350668 A1 Nov. 5, 2020

Related U.S. Application Data

(63) Continuation of application No. PCT/KR2019/000887, filed on Jan. 22, 2019.

(30) Foreign Application Priority Data

Jan. 23, 2018 (KR) ..... 10-2018-0008129

(51) Int. Cl.
*H01Q 1/24* (2006.01)
*H01Q 1/38* (2006.01)
(Continued)

(52) U.S. Cl.
CPC ..... *H01Q 1/38* (2013.01); *H01Q 1/422* (2013.01); *H01Q 5/328* (2015.01); *H01Q 5/35* (2015.01)

(58) Field of Classification Search
CPC ..... H01Q 1/38; H01Q 5/328; H01Q 5/35; H01Q 1/422; H01Q 1/523; H01Q 21/08; H01Q 9/0407; H01Q 1/2291; H01Q 1/243
See application file for complete search history.

(56) References Cited

U.S. PATENT DOCUMENTS 9,930,784 B2 * 3/2018 Lee ..... H01L 51/52
2004/0196190 A1 10/2004 Mendolia et al.
(Continued)

FOREIGN PATENT DOCUMENTS

CN 1497664 A 5/2004
CN 1862877 A 11/2006
(Continued)

OTHER PUBLICATIONS

Notice of Allowance dated Oct. 5, 2021 from Japan Patent Office in a counterpart Japan Patent Application No. 2020-538653 (all the cited references are listed in this IDS.) (English translation is also submitted herewith.).
(Continued)

*Primary Examiner* — David E Lotter
(74) *Attorney, Agent, or Firm* — The PL Law Group, PLLC

(57) ABSTRACT

A film antenna-circuit connection structure according to an embodiment of the present invention includes a film antenna including radiation patterns and pads, and a circuit board electrically connected to the film antenna. The film antenna includes connection wirings each of which is electrically connected to each of the pads of the film antenna, and a
(Continued)

dummy barrier interposed between neighboring connection wirings of the connection wirings.

14 Claims, 5 Drawing Sheets

(51) Int. Cl.

| | |
|---|---|
| ***H01Q 5/328*** | (2015.01) |
| ***H01Q 5/35*** | (2015.01) |
| ***H01Q 1/42*** | (2006.01) |

(56) References Cited

U.S. PATENT DOCUMENTS

| | | | | |
|---|---|---|---|---|
| 2006/0170597 | A1 | 8/2006 | Kurashima et al. | |
| 2007/0018749 | A1 | 1/2007 | Yamaguchi | |
| 2007/0238224 | A1 | 10/2007 | Liu | |
| 2009/0008131 | A1 | 1/2009 | Shibata et al. | |
| 2009/0058733 | A1* | 3/2009 | Kurashima | H01Q 1/44 343/700 MS |
| 2010/0167666 | A1 | 7/2010 | Choudhury et al. | |
| 2015/0255856 | A1* | 9/2015 | Hong | H01Q 21/061 343/702 |
| 2017/0164478 | A1 | 6/2017 | Lee | |
| 2019/0165486 | A1* | 5/2019 | Yoshida | H01Q 1/245 |

FOREIGN PATENT DOCUMENTS

| | | | |
|---|---|---|---|
| CN | 1976241 | A | 6/2007 |
| CN | 204833198 | U | 12/2015 |
| CN | 106132070 | A | 11/2016 |
| JP | H04-336702 | A | 11/1992 |
| JP | 2003-347692 | A | 12/2003 |
| JP | 2006-019108 | A | 1/2006 |
| JP | 2007-089109 | A | 4/2007 |
| KR | 10-2003-0095557 | A | 12/2003 |
| KR | 10-2004-0015909 | A | 2/2004 |
| KR | 10-0748575 | B1 | 8/2007 |
| KR | 10-2008-0086042 | A | 9/2008 |
| KR | 10-2009-0093076 | A | 9/2009 |
| KR | 10-2010-0006756 | A | 1/2010 |
| KR | 10-2013-0095451 | A | 8/2013 |
| KR | 10-2017-0030196 | A | 3/2017 |

OTHER PUBLICATIONS

International Search Report for PCT/KR2019/000887 dated May 3, 2019.

Office action dated Jun. 15, 2021 from Japan Patent Office in a counterpart Japan Patent Application No. 2020-538653 (all the cited references are listed in this IDS.) (English translation is also submitted herewith.).

Office action dated Feb. 28, 2022 from China Patent Office in a counterpart China Patent Application No. 2019-80009314 (all the cited references are listed in this IDS.) (English translation is also submitted herewith.).

Dai Xian-ju, "Anti-interference Design of RF Circuit", Communications Technology, vol. 46, No. 08, 2013, pp. 48-51 doi:10.3969/j.issn.1002-0802.2013.08.014 (English Abstract is included in the first page.).

J. Priscilla Elizabeth et al., "Rf coupling analysis via wire penetrating into an aperture", 2014 International Conference on Control, Instrumentation, Communication and Computational Technologies (ICCICCT), Jul. 2014, pp. 601-603.

* cited by examiner

FILM ANTENNA-CIRCUIT CONNECTION STRUCTURE AND DISPLAY DEVICE INCLUDING THE SAME

CROSS REFERENCE TO RELATED APPLICATIONS AND CLAIM OF PRIORITY

The present application is a continuation application to International Application No. PCT/KR2019/000887 with an International Filing Date of Jan. 22, 2019, which claims the benefit of Korean Patent Application No. 10-2018-0008129 filed on Jan. 23, 2018 at the Korean Intellectual Property Office, the disclosures of which are incorporated by reference herein in their entirety.

BACKGROUND

1. Field

The present invention relates to a film antenna-circuit connection structure and a display device including the same. More particularly, the present invention relates to a film antenna-circuit connection structure including a plurality of connecting wirings and a display device including the same.

2. Description of the Related Art

As information technologies have been developed, a wireless communication technology such as Wi-Fi, Bluetooth, etc., is combined with a display device in, e.g., a smartphone form. In this case, an antenna may be combined with the display device to provide a communication function.

As mobile communication technologies have been rapidly developed, an antenna capable of operating high-frequency or ultra-high frequency communication is needed in the display device.

For example, an intermediate circuit may be needed for a signal transmission and reception between a driving integrated circuit (IC) and a radiation pattern or an electrode of an antenna. However, when wirings for connecting a plurality of antenna electrodes are dense, a signal error or a signal loss due to interruption or noise between the wirings may be caused. Further, in, e.g., a recent 5G high-frequency communication, as a wavelength and a frequency band capable of being sensed may be decreased, the signal loss or signal blocking may become greater.

Additionally, as the display device to which the antenna is employed becomes thinner and light-weighted, a space for accommodating the antenna may also be decreased. Accordingly, a high-frequency and broad-band signaling may not be easily implemented in a limited space.

SUMMARY

According to an aspect of the present invention, there is provided a film antenna-circuit connection structure having improved efficiency of signal transmission and reception.

According to an aspect of the present invention, there is provided a circuit board capable of being combined with an antenna having improved efficiency of signal transmission and reception.

According to an aspect of the present invention, there is provided a display device including a film antenna-circuit connection structure having improved efficiency of signal transmission and reception.

The above aspects of the present invention may be achieved by one or more of the following features or constructions:

(1) A film antenna-circuit connection structure, comprising: a film antenna including radiation patterns and pads; and a circuit board electrically connected to the film antenna, the circuit board including: connection wirings each of which is electrically connected to each of the pads of the film antenna; and a dummy barrier interposed between neighboring connection wirings of the connection wirings.

(2) The film antenna-circuit connection structure according to the above (1), wherein the dummy barrier has a line shape extending in a direction the same as that of the connection wirings.

(3) The film antenna-circuit connection structure according to the above (1), wherein the dummy barrier includes pillars independently arranged from each other.

(4) The film antenna-circuit connection structure according to the above (3), wherein the pillars are arranged along an extension direction of the connection wirings between the neighboring connection wirings.

(5) The film antenna according to the above (4), wherein the pillars are arranged in a zigzag construction along the extension direction of the connection wirings.

(6) The film antenna-circuit connection structure according to the above (3), wherein the circuit board further includes an insulation layer, and the pillars are embedded in the insulation layer.

(7) The film antenna-circuit connection structure according to the above (6), wherein the circuit board further includes a dummy ground pattern disposed on a bottom surface of the insulation layer to be electrically connected to at least one of the pillars.

(8) The film antenna-circuit connection structure according to the above (1), further comprising a driving integrated circuit chip electrically connected to the connection wirings of the circuit board.

(9) The film antenna-circuit connection structure according to the above (8), wherein the driving integrated circuit chip includes driving pads each of which is electrically connected to each of the connection wirings.

(10) The film antenna-circuit connection structure according to the above (9), wherein the driving integrated circuit chip further includes a dummy pad electrically connected to the dummy barrier

(11) The film antenna-circuit connection structure according to the above (1), wherein the film antenna further includes transmission lines connecting the radiation patterns and the pads with each other.

(12) The film antenna-circuit connection structure according to the above (1), wherein the film antenna further includes a dielectric layer, and the radiation patterns and the pads are disposed on a top surface of the dielectric layer.

(13) The film antenna-circuit connection structure according to the above (12), wherein the film antenna further includes a ground layer formed on a bottom surface of the dielectric layer.

(14) A display device comprising the film antenna-circuit connection structure according to exemplary embodiments as described above.

(15) A circuit board, comprising: a core layer including a resin material; connection wirings formed on the core layer or at least partially embedded in the core layer; and a dummy barrier interposed between neighboring connection wirings of the connection wirings.

(16) The circuit board according to the above (15), wherein the dummy barrier includes at least one of a ground line and ground pillars, the ground line extending in a direction the same as that of the connection wirings, the ground pillars formed through the core layer.

(17) The circuit board according to the above (15), wherein one ends of the connection wirings are configured to be connected to a film antenna, and the other ends of the connection wirings are configured to be connected to a driving integrated circuit chip.

In a film antenna-circuit connection structure according to exemplary embodiments of the present invention, a circuit board may include a dummy barrier disposed between wirings connected to each antenna pad. Noise and interference between neighboring wires may be shielded by the dummy barrier so that reliability of desired signal transmission and reception may be improved.

The dummy barrier may serve as a dummy ground, and thus noises generated between the wirings may be efficiently removed.

In some embodiments, a film antenna may include radiation patterns that may be independently controlled so that signal directivity and gain property may be improved. Thus, signals from each of the radiation patterns may be transferred via the construction of the circuit board without signal loss.

The film antenna-circuit connection structure may be applied to a display device including a mobile communication device capable of performing signal transmission and reception at high-frequency or ultra-high frequency bands corresponding to 3G, 4G, 5G or more to improve radiation property and communication reliability.

DETAILED DESCRIPTION OF THE EMBODIMENTS

According to exemplary embodiments of the present invention, there is a provided a film antenna-circuit connection structure which includes a film antenna including radiation patterns and pads, and a circuit board including wirings each of which is connected to each pad of the film antenna and a dummy barrier interposed between the neighboring wirings.

The film antenna may be, e.g., a microstrip patch antenna fabricated as a transparent film. The film antenna may be applied to, e.g., a communication device for high frequency or ultrahigh frequency (e.g., 3G, 4G, 5G or more) mobile communications.

According to exemplary embodiments of the present invention, a display device including the film antenna-circuit connection structure is also provided.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
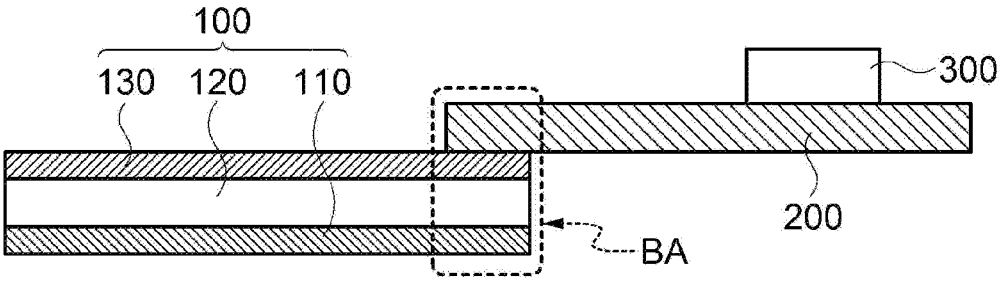
FIGS. 1 and 2 are schematic cross-sectional and top planar views, respectively, illustrating a film antenna-circuit connection structure in accordance with exemplary embodiments.
Figure 2:
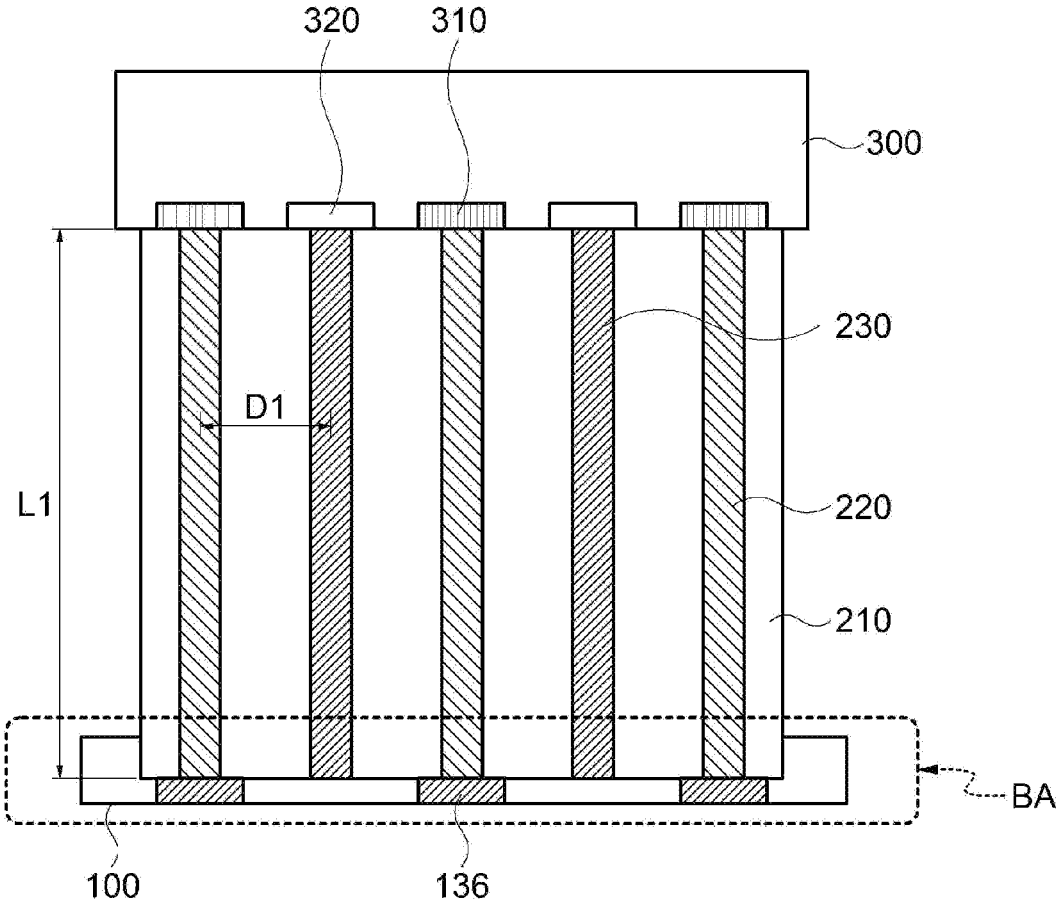

FIGS. 1 and 2 are schematic cross-sectional and top planar views, respectively, illustrating a film antenna-circuit connection structure in accordance with exemplary embodiments.

Referring to FIGS. 1 and 2, the film antenna-circuit connection structure (hereinafter, abbreviated as a connection structure) may include a film antenna 100 and a circuit board 200. A driving integrated circuit (IC) chip 300 being connected to connection wirings 220 of the circuit board 200 and controlling transmission/reception signals may be disposed on the circuit board 200.

The film antenna 100 may be provided as a stacked structure including a first conductive layer 130, a dielectric layer 120 and a second conductive layer 110. For example, the first conductive layer 130 and the second conductive layer 110 may be formed on top and bottom surfaces of the dielectric layer 120, respectively.

The dielectric layer 120 may include an insulating material having a predetermined dielectric constant. The dielectric layer 120 may include, e.g., an inorganic insulating material such as glass, silicon oxide, silicon nitride and a metal oxide, etc., or an organic insulating material such as an epoxy resin, an acryl resin, an imide-based resin, etc. The dielectric layer 120 may serve as a film substrate of the film antenna.

The dielectric layer 120 may include a transparent film. For example, the transparent film may include, e.g., a polyester-based resin such as polyethylene terephthalate, polyethylene isophthalate, polyethylene naphthalate, polybutylene terephthalate, etc.; a cellulose-based resin such as diacetyl cellulose, triacetyl cellulose, etc.; a polycarbonate-based resin; an acryl-based resin such as polymethyl (meth) acrylate, polyethyl (meth)acrylate, etc.; a styrene-based resin such as polystyrene, an acrylonitrile-styrene copolymer; a polyolefin-based resin such as polyethylene, polypropylene, a polyolefin having a cyclo-based or norbornene structure, ethylene-propylene copolymer, etc.; a vinyl chloride-based resin; an amide-based resin such as nylon, an aromatic polyamide, etc.; an imide-based resin; a polyether sulfone-based resin; a sulfone-based resin; a polyether ketone-based resin; a polyphenylene sulfide-based resin; a vinyl alcohol-based resin; a vinylidene chloride-based resin; a vinyl butyral-based resin; an allylate-based resin; a polyoxymethylene-based resin; an epoxy-based resin; a urethane or acryl urethane-based resin; a silicone-based resin, etc. These may be used alone or in a combination thereof.

In some embodiments, the dielectric layer 120 may include an adhesive film including a pressure-sensitive adhesive (PSA) or an optically clear adhesive (OCA).

The first conductive layer 130 may include radiation patterns and pads 136 of the film antenna 100. The second conductive layer 110 may serve as a ground layer or ground pattern of the film antenna 100. In an embodiment, a conductive member of the display device on which the film antenna-circuit connection structure is employed may serve as a second conductive layer 110 (e.g., the ground layer).

The conductive member may include, e.g., a gate electrode of a thin film transistor (TFT) included in a display panel, various wirings such as a scan line or a data line, or various electrodes such as a pixel electrode or a common electrode.

The first and second conductive layers 130 and 110 may be formed of silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), tin (Sn), zinc (Zn), molybdenum (Mo), calcium (Ca) or an alloy thereof. These may be used alone or in a combination thereof. For example, the first and second conductive layers 130 and 110 may be formed of silver (Ag) or a silver alloy (e.g., a silver-palladium-copper (APC) alloy), or copper or a copper alloy (e.g., a copper-calcium (CuCa) alloy) for implementing a low resistance and a fine line width.

The first and second conductive layers 130 and 110 may include a transparent conductive oxide such as indium tin oxide (ITO), indium zinc oxide (IZO), zinc oxide (ZnOx), indium zinc tin oxide (IZTO), etc.

In some embodiments, the first and second conductive layers 130 and 110 may have a multi-layered structure including a metal or alloy layer and a transparent conductive oxide layer.

The film antenna 100 may include the pads 136, each of which may be connected to the radiation pattern at one end portion thereof. For example, the one end portion of the film antenna 100 may be provided as a bonding area BA configured to be connected or bonded to the circuit board 200.

The circuit board 200 may at least partially cover the bonding area BA of the film antenna 100, and may be electrically connected to the pads 136. The circuit board 200 may include an insulation layer 210 and connection wirings 220, and each connection wiring 220 of the circuit board 200 may be electrically connected to each pad 136 of the film antenna 100.

The insulation layer 210 may include, e.g., a flexible resin material such as polyimide, an epoxy resin, polyester, and a liquid crystal polymer (LCP). In this case, the circuit board 200 may be provided as a flexible printed circuit board (FPCB). For example, the insulation layer 210 may serve as a core layer of the circuit board 200.

The connection wirings 220 may be arranged on the insulation layer 210. In some embodiments, the connection wirings 220 may be printed or embedded in the insulation layer 210. A coverlay layer covering the connection wirings 220 may be further formed on the insulation layer 210.

The connection wiring 220 may be in direct contact with the pad 136 or may be electrically connected to the pad 136 through a contact (not illustrated) formed in the insulation layer 210.

A dummy barrier 230 may be disposed between the neighboring connection wirings 220. In some embodiments, the dummy barrier 230 may have a substantially same shape as that of the connecting wiring 220, and may have a wiring shape or a line shape extending in the same direction as that of the connection wiring 220.

The term "dummy barrier" used herein may indicate a conductive pattern that is not directly connected to the radiation pattern, and in one embodiment, that may function as a ground pattern.

For example, the dummy barrier 230 may be disposed on the insulation layer 210 or may be printed or embedded in the insulation layer 210.

The connection wiring 220 and the dummy barrier 230 may include a low-resistance metal to improve signal transmission speed. For example, the connection wiring 220 and the dummy barrier 230 may include silver (Ag), gold (Au), copper (Cu), aluminum (Al), platinum (Pt), palladium (Pd), chromium (Cr), Titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy thereof. In some embodiments, the connection wiring 220 and the dummy barrier 230 may include the same metal.

As described above, according to exemplary embodiments, the dummy barrier 230 may be disposed between the neighboring connection wires 220 to serve as a noise shielding pattern.

When the film antenna 100 includes a plurality of the radiation patterns, signals may be individually transmitted through each of the connection wirings 220 of the circuit board 200. In this case, each signal of the neighboring connection wirings 220 may be interrupted with each other, and a signal of one connection wiring 220 may act as a noise to a signal of the other connection wiring 220.

However, according to exemplary embodiments, the dummy barrier 230 may be interposed between the neighboring connection wirings 220 to block the noise and interruption. Accordingly, signals of desired phase and frequency may be generated or transmitted with high reliability from each connection wiring 220.

When the connection structure is applied to a display device, noises generated from pixel electrodes and wirings of a display panel may be propagated to the connection structure. In this case, the dummy barrier 230 may also block the noises from the display panel, thereby further improving reliability of signal transmission and reception.

In some embodiments, the dummy barrier 230 may be connected to a ground pad or a ground layer included in the film antenna 100 to serve as a ground line.

In some embodiments, a spacing distance D1 between the connection wiring 220 and the dummy barrier 230 (e.g., the shortest distance between central lines of the connection wiring 220 and the dummy barrier 230) may be from about 10 μm to about 500 μm. If the spacing distance D1 is less than about 10 μm, a parasitic capacitance between the connection wiring 220 and the dummy barrier 230 may be caused to result in a signal disturbance. If the spacing distance D1 exceeds about 500 μm, the noise shielding effect by the dummy barrier 230 may not be substantially implemented.

A width of the connection wiring 220 may be adjusted in consideration of the spacing distance D1 from the dummy barrier 230 and an impedance of the connection wiring 220. In some embodiments, the width of the connecting wirings 220 may be from about 50 μm to about 500 μm. A length L1 of the connection wiring 220 may be adjusted to 20 mm or less in consideration of a signal loss.

As illustrated in FIG. 2, one end portion of the circuit board 200 may be electrically connected to the film antenna 100 in the bonding area BA, and the other end portion of the circuit board 200 may be electrically connected to the driving IC chip 300.

The driving IC chip 300 may include driving pads 310 and a control circuit (not illustrated) connected to the driving pads 310. Each driving pad 310 may be connected to each connection wiring 220. Accordingly, the radiation patterns included in the film antenna 100 may be independently controlled through each driving pad 310.

In some embodiments, the driving IC chip 300 may further include a dummy pad 320. The dummy barrier 230 extends in a wiring shape or a line shape, and may be electrically connected to the dummy pad 320 of the driving IC chip 300. In this case, noises absorbed through the dummy barrier 230 may be easily discharged through the dummy pad 320.

In this case, the dummy barrier 230 may serve as a dummy ground. In an embodiment, the driving IC chip 300 may further include a ground circuit connected to the dummy pad 320.

Figure 3:
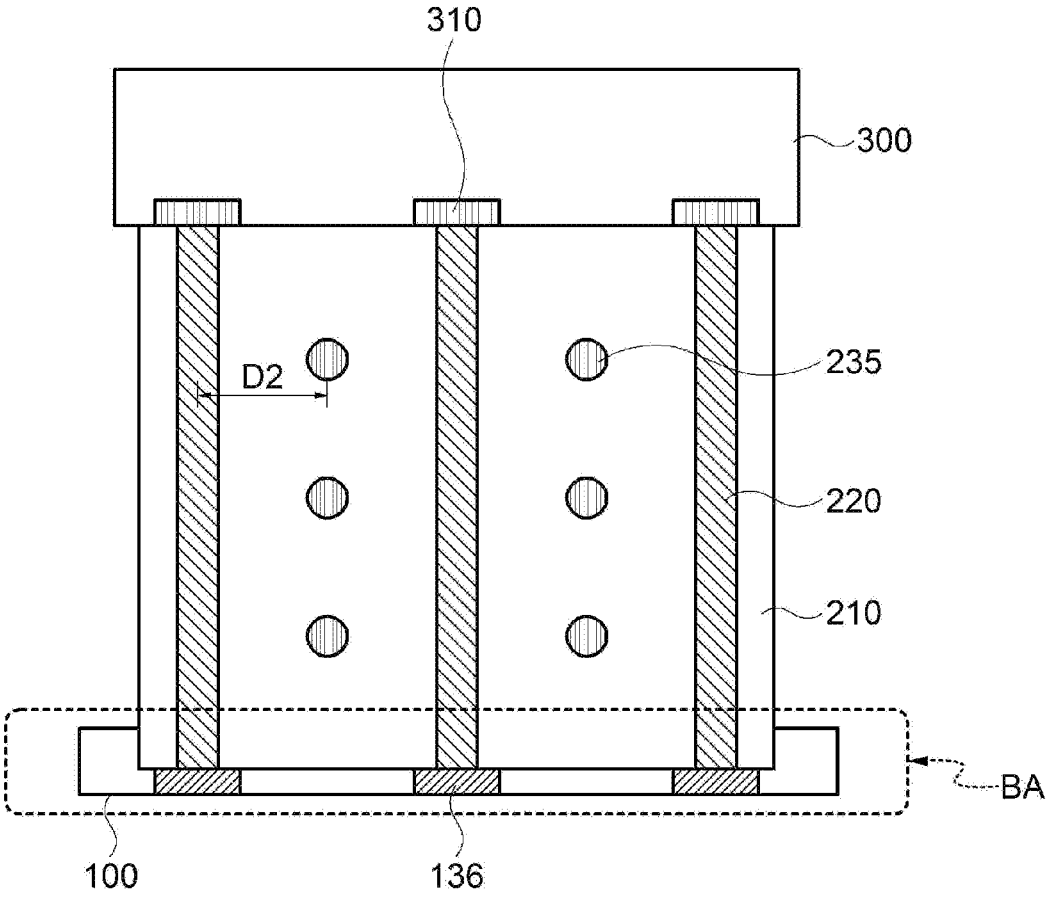
FIGS. 3 and 4 are schematic top planar views illustrating film antenna-circuit connection structures in accordance with some exemplary embodiments.
Figure 4:
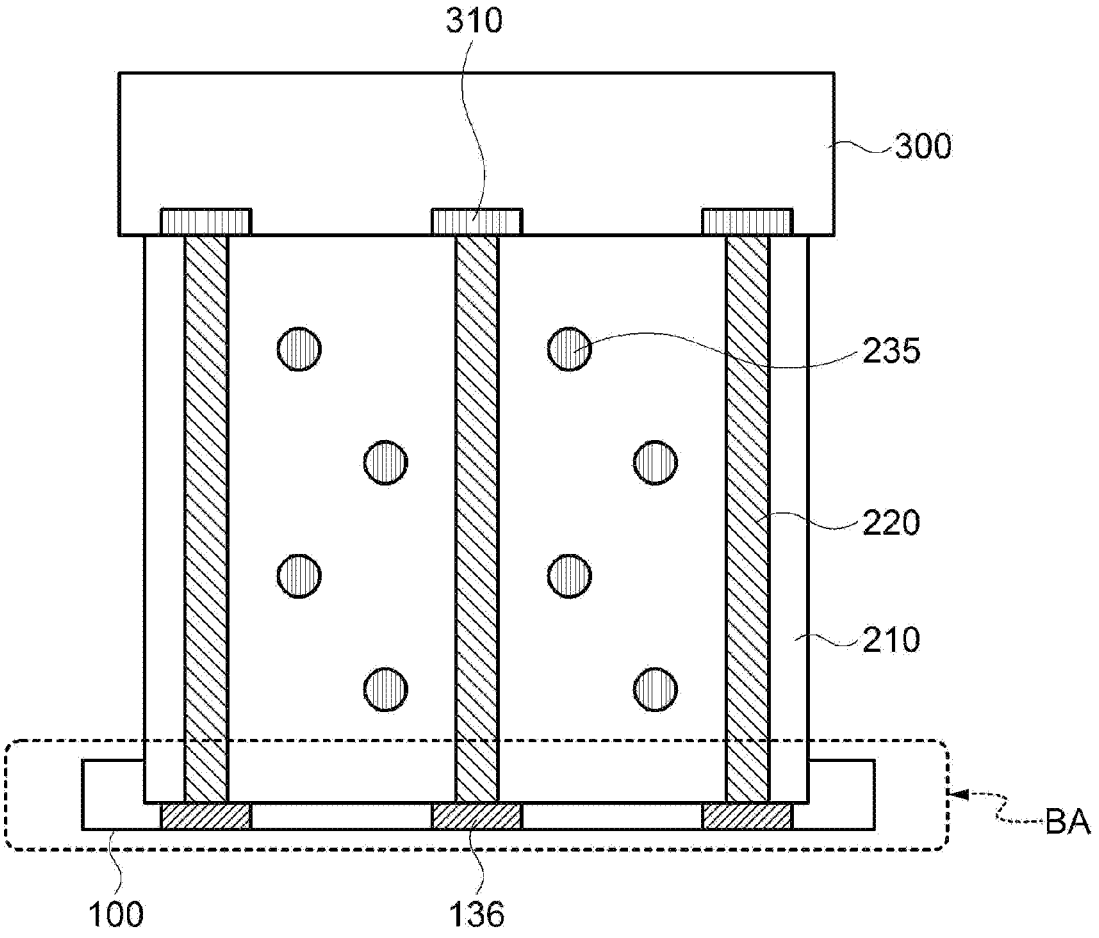

FIGS. 3 and 4 are schematic top planar views illustrating film antenna-circuit connection structures in accordance with some exemplary embodiments. Detailed descriptions on elements and structures substantially the same as or similar to those described with reference to FIGS. 1 and 2 are omitted herein.

Referring to FIG. 3, a dummy barrier 235 of the film antenna-circuit connection structure may include pillar or columnar patterns that may be independently formed from each other. As illustrated in FIG. 3, the dummy barrier 235 may have a circular cross section, but is not limited thereto. Hereinafter, the pillar will be described using the same reference numeral as that of the dummy barrier.

In exemplary embodiments, a plurality of pillars 235 may be arranged between the neighboring connection wirings 220. In some embodiments, a plurality of the pillars 235 may be arranged along an extension direction of the connection wiring 220.

The pillar 235 may be embedded in the insulation layer 210. In some embodiments, the pillar 235 may penetrate the insulation layer 210. For example, after forming a hole in the insulation layer 210, the pillar 235 may be formed in the hole by a plating process such as a copper plating process.

As the dummy barrier 235 is formed of a plurality of the pillars, a position and a density of the dummy barrier 235 may be efficiently changed according to a noise generating position. Accordingly, a degree of freedom for designing the dummy barrier 235 may be improved.

In some embodiments, a spacing distance D2 between the connection wiring 220 and the dummy barrier 235 (or the pillar) (e.g., a minimum distance between a central line of the connection wiring 220 and a center of the dummy barrier 235) may be from about 10 μm to about 500 μm.

Referring to FIG. 4, the pillar-shaped dummy barriers 235 may be arranged in a zigzag construction along the extending direction of the connection wiring 220. In this case, the dummy barriers 235 may be disposed to be closer to each connection wiring 220 to provide, e.g., a doubled barrier effect.

Figure 5:
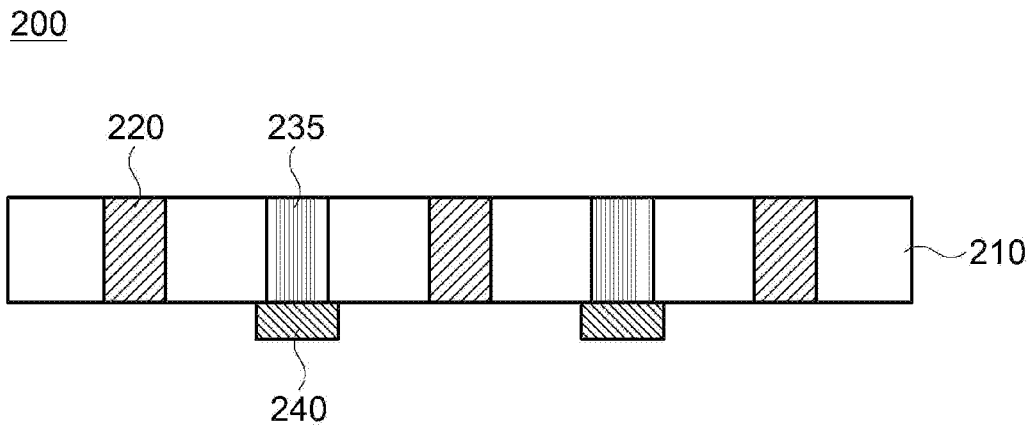
FIG. 5 is a schematic cross-sectional view illustrating a circuit board in accordance with some exemplary embodiments.

FIG. 5 is a schematic cross-sectional view illustrating a circuit board in accordance with some exemplary embodiments. For example, FIG. 5 is a cross-sectional view of a circuit board including the pillar-shaped dummy barrier as illustrated in FIGS. 3 and 4.

Referring to FIG. 5, the circuit board 200 may include the insulation layer 210, the connection wiring 220, and the dummy barrier 235 having the pillar shape.

The dummy barrier 235 may be formed through the insulation layer 210 as described with reference to FIGS. 3 and 4, and may absorb noises generated from the neighboring connection wirings 220.

A dummy ground pattern 240 connected to the dummy barrier 235 may be disposed on a bottom surface of the insulation layer 210. The dummy ground pattern 240 may extend in substantially the same direction as that of the connection wiring 220, and may be connected commonly with a plurality of the dummy barriers 235. The noises absorbed from the dummy barrier 235 may be easily discharged to an outside by the dummy ground pattern 240.

In FIG. 5, the connection wiring 220 is illustrated as penetrating through the insulation layer 210, but is not limited thereto. For example, the connection wiring 220 may be disposed on the insulation layer 210 or may be partially embedded in the insulation layer 210.

Figure 6:
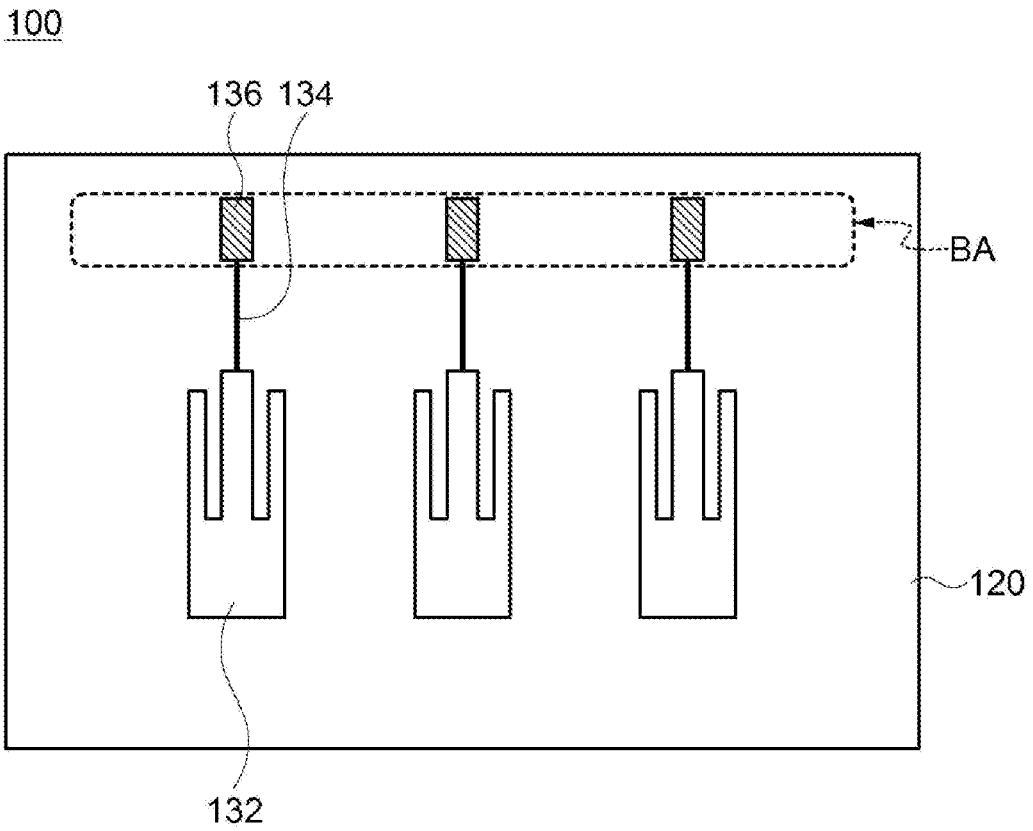
FIG. 6 is a schematic top planar view illustrating a film antenna in accordance with exemplary embodiments.

FIG. 6 is a schematic top planar view illustrating a film antenna in accordance with exemplary embodiments.

Referring to FIG. 6, the film antenna 100 may include a radiation pattern 132, a transmission line 134 and a pad 136 arranged on a dielectric layer 120. As described with reference to FIG. 1, the radiation pattern 132, the transmission line 134 and the pad 136 may be included as the first conductive layer 130 of the film antenna 100.

In exemplary embodiments, a plurality of the radiation patterns 132 that may be independently operated may be arranged on the dielectric layer 120 along a width direction of the film antenna 100. The transmission line 134 may connect the radiation pattern 132 and the pad 136 with each other along a length direction of the film antenna 100.

The pad 136 may be electrically connected to the connection wiring 220 as described with reference to FIGS. 1 and 2. Accordingly, each radiation pattern 132 may be independently controlled through the driving IC chip 300. Additionally, independent operational reliability of each radiation pattern 132 may be improved by the dummy barrier 230 included in the circuit board 200.

In some embodiments, the radiation pattern 132 may include a mesh structure. Accordingly, a transmittance of the film antenna 100 may be further improved. In an embodiment, a dummy mesh may be arranged on a portion of the dielectric layer 120 around the radiation pattern 132. Thus, a visible recognition of electrodes in the film antenna 100 caused by local pattern variations of the film antenna 100 may be prevented or reduced.

As described above, the pads 136 each of which may be electrically connected to each radiation pattern 132 may be disposed in the bonding area BA to be connected to the circuit board 200.

Figure 7:
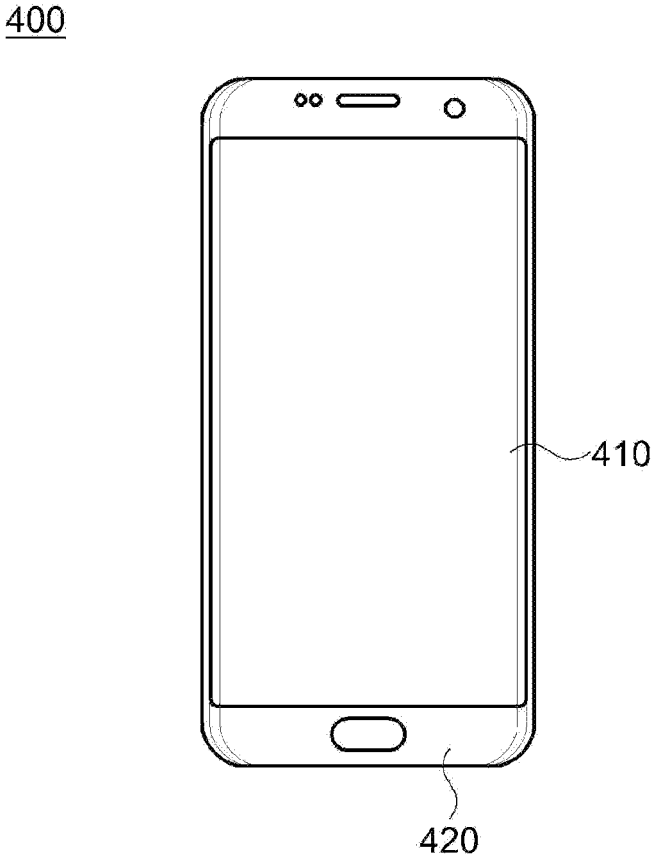
FIG. 7 is a schematic top planar view illustrating a display device in accordance with exemplary embodiments.

FIG. 7 is a schematic top planar view illustrating a display device in accordance with exemplary embodiments. For example, FIG. 7 illustrates an external shape including a window of a display device.

Referring to FIG. 7, a display device 400 may include a display region 410 and a peripheral region 420. For example, the peripheral region 420 may be located at both lateral portions and/or both end portions of the display region 410.

In some embodiments, the above-described film antenna may be inserted in a patch shape in the peripheral region 420 of the display device 400. In some embodiments, the bonding area BA of the film antenna 100 as described with reference to FIG. 6 may be located to correspond to the peripheral region 420 of the display device 400.

The peripheral region 420 may correspond to, e.g., a light-shielding portion or a bezel portion of the display device. The circuit board and the driving IC chip of the film antenna-circuit connection structure may be also disposed in the peripheral region 420.

The bonding area BA of the film antenna 100 may be arranged to be adjacent to the driving IC chip in the peripheral region 420 so that a signal transmission/reception path may become shorter to suppress signal loss.

According to embodiments of the present invention as described above, a circuit board combined with, e.g., the film antenna 100 capable of implementing signal transmission and reception with improved reliability and reduced noise may be provided.

As described above, the circuit board may include the connection wiring and the dummy barrier, and may be provided as a flexible printed circuit board (FPCB) by being combined with a core layer including a resin material.

What is claimed is:

1. A film antenna-circuit connection structure, comprising:

a film antenna comprising radiation patterns and pads; and a circuit board electrically connected to the film antenna, the circuit board comprising:

connection wirings each of which is electrically connected to each of the pads of the film antenna; and a dummy barrier interposed between neighboring connection wirings of the connection wirings.

2. The film antenna-circuit connection structure according to claim 1, wherein the dummy barrier has a line shape extending in a direction the same as that of the connection wirings.

3. The film antenna-circuit connection structure according to claim 1, wherein the dummy barrier comprises pillars independently arranged from each other.

4. The film antenna-circuit connection structure according to claim 3, wherein the pillars are arranged along an extension direction of the connection wirings between the neighboring connection wirings.

5. The film antenna according to claim 4, wherein the pillars are arranged in a zigzag construction along the extension direction of the connection wirings.

6. The film antenna-circuit connection structure according to claim 3, wherein the circuit board further comprises an insulation layer, and the pillars are embedded in the insulation layer.

7. The film antenna-circuit connection structure according to claim 6, wherein the circuit board further comprises a dummy ground pattern disposed on a bottom surface of the insulation layer to be electrically connected to at least one of the pillars.

8. The film antenna-circuit connection structure according to claim 1, further comprising a driving integrated circuit chip electrically connected to the connection wirings of the circuit board.

9. The film antenna-circuit connection structure according to claim 8, wherein the driving integrated circuit chip comprises driving pads each of which is electrically connected to each of the connection wirings.

10. The film antenna-circuit connection structure according to claim 9, wherein the driving integrated circuit chip further comprises a dummy pad electrically connected to the dummy barrier.

11. The film antenna-circuit connection structure according to claim 1, wherein the film antenna further comprises transmission lines connecting the radiation patterns and the pads with each other.

12. The film antenna-circuit connection structure according to claim 1, wherein the film antenna further comprises a dielectric layer, and the radiation patterns and the pads are disposed on a top surface of the dielectric layer.

13. The film antenna-circuit connection structure according to claim 12, wherein the film antenna further comprises a ground layer formed on a bottom surface of the dielectric layer.

14. A display device comprising the film antenna-circuit connection structure according to claim 1.

* * * * *